US005303623A

United States Patent [19]

Chiloff

[11] Patent Number: 5,303,623

[45] Date of Patent: Apr. 19, 1994

[54] CLEARING DEVICE ASSOCIATED WITH A ROTARY CUTTING APPARATUS OF A WEB OF MATERIAL

[75] Inventor: Serge Chiloff, Loiret, France

[73] Assignee: A.T.N. French Societe Anonyme, Loiret, France

[21] Appl. No.: 813,077

[22] Filed: Dec. 24, 1991

[30] Foreign Application Priority Data

Dec. 26, 1990 [FR] France ..... 90 16263

[51] Int. Cl.[5] ..... B26D 7/18

[52] U.S. Cl. ..... 83/121; 83/145; 83/151; 493/342; 493/373; 493/472

[58] Field of Search ..... 83/145, 119, 120, 121, 83/122, 151; 241/167; 493/342, 373, 472

[56] References Cited

U.S. PATENT DOCUMENTS

| | | | |
|---|---|---|---|
| 534,884 | 2/1895 | Holmes | 83/120 |
| 909,853 | 1/1909 | Denison | 83/121 |
| 1,096,733 | 5/1914 | May | 83/120 |
| 2,341,956 | 2/1944 | Staude | 83/120 |
| 4,638,934 | 1/1987 | Fram | 83/122 X |

FOREIGN PATENT DOCUMENTS

| | | | |
|---|---|---|---|
| 624875 | 1/1936 | Fed. Rep. of Germany | 241/167 |
| 302926 | 11/1954 | Switzerland | 83/122 |

*Primary Examiner*—Hien H. Phan
*Assistant Examiner*—Clark F. Dexter
*Attorney, Agent, or Firm*—Browdy and Neimark

[57] ABSTRACT

The common base of the comb-shaped clearing device is made of a shaft. Screws are provided for blocking pairs of parallel arms on a shaft in variable positions as a function of a longitudinal position of a series of points on the cutting cylinder (2). The two arms of each pair, which are symmetrical with respect to a symmetry vertical plane, have inner faces turned toward one another and formed in such a manner as to define therebetween an interval having a width which increases from front to rear.

4 Claims, 1 Drawing Sheet

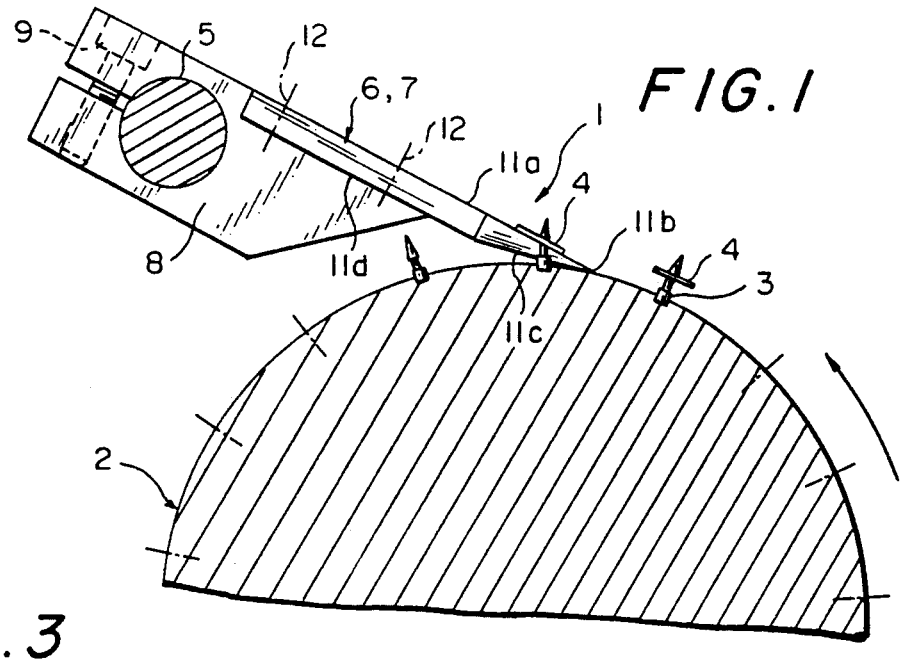
FIG. 1
FIG. 3
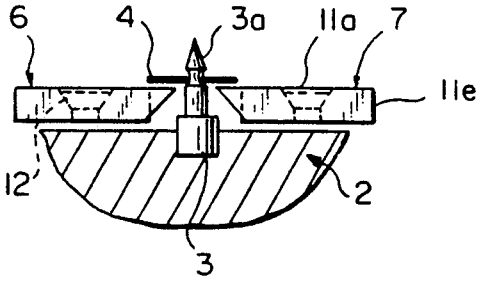
FIG. 4
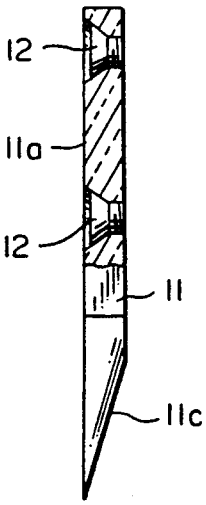
FIG. 2
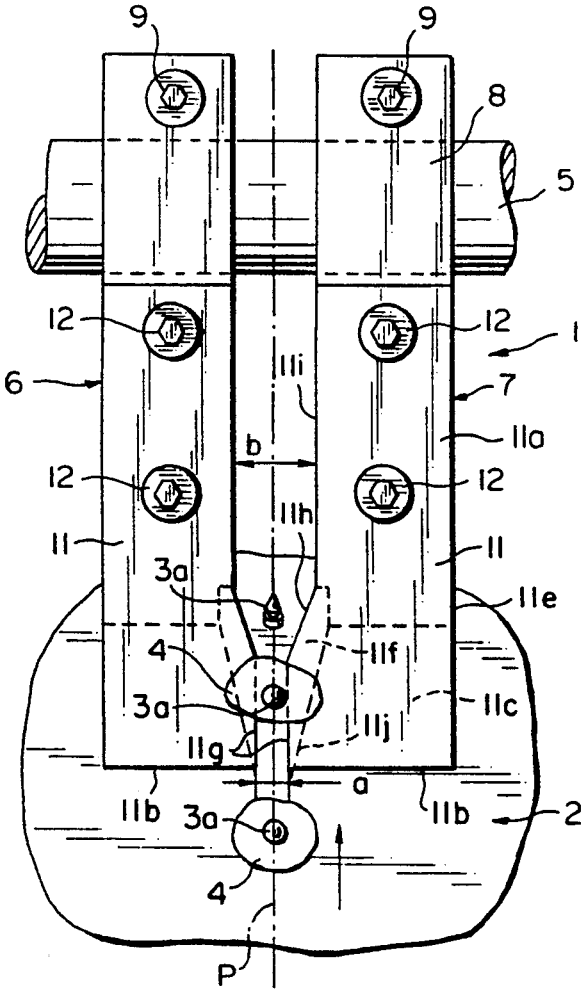

CLEARING DEVICE ASSOCIATED WITH A ROTARY CUTTING APPARATUS OF A WEB OF MATERIAL

FIELD OF THE INVENTION

The present invention relates to a clearing device associated with a rotary cutting apparatus for a web of material such as a web of cardboard or similar material.

BACKGROUND OF THE INVENTION

Rotary cutting apparatus for cutting individual blanks from a web of material such as a web of cardboard, these individual blanks being adapted for ulteriorly forming packagings, for example, are currently used in industry. After the cutting of these individual blanks, there always remain scraps or rejects of cardboard which correspond to the zones of the web which are not used for forming the individual blanks. These cardboard scraps must be eliminated from the surface of the cutting cylinder after each cutting operation. To this effect, piercing points or spockets are carried by the surface of the cylinder in positions where the scraps are formed after cutting. Each bit of cardboard which forms a scrap is thus pierced by a piercing point and is carried, while being maintained on this piercing point, towards a clearing device adapted for relieving, from each point, the bit of cardboard carried by this piercing point.

The clearing devices currently known include generally a comb-shaped unitary member having teeth directed toward the surface of the cutting cylinder and inclined according to an appropriate angle with respect to this surface. Such a unitary clearing comb is positioned so that the various piercing points carried by the cutting cylinder will pass in intervals between teeth of the comb. Therefore the cardboard scraps carried by the outer extreme end portions of the piercing points are detached progressively from these piercing points by sliding on the neighboring teeth of the unitary clearing comb. A clearing device of this type has however a disadvantage in that there is often a jamming of cardboard bits in the bottom of the intervals between the teeth of the clearing comb, and these cardboard bits can accumulate together and will eventually cause a breaking of the piercing points when an obstacle, which is progressively formed by the carboard bits, is sufficiently important.

OBJECT AND SUMMARY OF THE INVENTION

The present invention has essentially for its object to remedy the above disadvantage by providing a clearing device of a particularly simple design and ensuring the clearing operation in an efficient manner and without any risk of jamming.

Thus and according to this invention, the clearing device associated with a rotary cutting apparatus for cutting a web of material, such as a web of cardboard and the like, this clearing device being comb shaped and having a common base parallel to an axis of a cutting cylinder of the rotary cutting apparatus, and forming a support for a series of parallel arms or teeth extending towards the cutting cylinder and ending at an anterior portion in an immediate vicinity of a peripheral surface of the cutting cylinder, these parallel arms therebetween defining intervals through which are provided to pass a series of piercing points rigidly connected to the peripheral surface of the cutting cylinder, these piercing points transporting bits of material in the form of a number of cutting scraps which have been cut from the web of material and are subsequently detached from the piercing points by the parallel arms of the clearing device, is characterized in that the common base of the comb-shaped clearing device is made of a shaft, screws being provided for locking pairs of parallel arms on this shaft in variable positions as a function of a longitudinal position of the series of piercing points on the cutting cylinder, and in that the two arms of each pair, which are symmetrical with respect to a vertical plane of symmetry, have inner faces, these inner faces being directed toward one another and formed in such a manner as to define therebetween an interval having a width which increases from a front to a rear, of the inner faces and increases thereby from ends of the parallel arms to the shaft forming the common base.

BRIEF DESCRIPTION OF THE DRAWINGS

An embodiment of the present invention will be described hereafter by way of a non limiting example with reference to the accompanying drawings, wherein:

FIG. 1 is a vertical cross sectional view of the clearing device of this invention, associated with a cutting cylinder of a rotary cutting apparatus;

FIG. 2 is an enlarged partial plan view of the clearing device;

FIG. 3 is a front view of two adjacent scrapers of the clearing device;

FIG. 4 is a partially sectional side view of a scraper from plane P of FIG. 2.

DESCRIPTION OF THE PREFERRED EMBODIMENT

Referring now to the drawings, the comb-shaped clearing device of this invention, which is generally designated at 1 in FIG. 1, is associated with a cutting cylinder 2 of a rotary cutting apparatus. This cutting cylinder 2 has a peripheral surface carrying a set of cutting ridges provided for the cutting of a web of material, such as a web of cardboard, according to a predetermined pattern, for constituting individual cardboard blanks from this web.

The areas which remain after the cutting of the individual blanks, and which form therefore cutting scraps, have to be eliminated. To this effect, the cutting cylinder 2 is provided, in positions at which these scraps are formed, with a series of piercing points 3 embedded in a peripheral surface of the cylinder 2 and having a pointed outer end 3*a* as shown in FIG. 3. Thus following a cutting operation, the piercing points 3 are driven in, by their pointed ends 3*a*, in cardboard bits 4 forming cutting scraps. The clearing device 1 is adapted for clearing all cardboard bits 4 from the piercing points 3.

According to the invention, the clearing device 1 which is generally placed above the cutting cylinder 2 but which could be placed in another suitable position, includes a longitudinal shaft 5, that is parallel to a longitudinal axis of the cutting cylinder 2. On this shaft 5 are fixed arms 6, 7. The arms 6, 7 extend substantially radially relative to the shaft, parallel to each other and spaced apart from one another, for forming, so to speak, the teeth of the clearing comb 1.

The arms 6, 7 are arranged by pairs and are, symmetrical to one another with respect to a same vertical plane of symmetry P, these arms extending toward the cutting cylinder 2 and ending in an immediate vicinity of the cylinder 2.

In FIG. 2, two of the arms 6, 7 are shown, viz, a left hand arm 6 and a right hand arm 7, symmetrical with respect to a vertical plane of symmetry P. Each of the arms 6 and 7 has a base 8 formed by a support block clamped and locked on the shaft 5 by means of a screw 9, and an anterior portion forming a scraper 11 which extends from the base 8 and is fixed on the base 8 by means of screws 12. Each scraper 11 has a flat upper surface 11*a* which is inclined with respect to horizontal and which ends into a horizontal edge 11*b*, parallel to the longitudinal axis of the cutting cylinder 2, situated in an immediate vicinity of the lateral surface of the cutting cylinder 2.

The edge 11*b* is part of an acute angle dihedron formed by the upper surface 11*a* and a lower end anterior surface 11*c* which is inclined so that the extreme end portion of each scraper 11 is tapered. The inclined lower and anterior surface 11*c* is joined to a lower and posterior surface 11*d* which is parallel to the upper surface 11*a* and which is locked on a flat upper face of the base 8 under the action of locking screws 12.

As seen in a plan view, each scraper 11 is defined by an outer vertical surface 11*e* which is rectilinear. On an other hand, the inner surface of each scraper 11, that is the surface which faces the vertical plane of symmetry P and the other scraper, is stepped and comprises, in its anterior portion, a flat anterior inner surface 11*f* which is inclined both downwardly and rearwardly.

The inclined anterior surface 11*f* is defined, at its upper portion, by an anterior and superior edge 11*g* which is contained in the plane of the upper surface 11*a*, parallel to the vertical and plane of symmetry P and connected perpendicularly to the edge 11*b*, and by another upper edge 11*h* also contained in the plane of the upper surface 11*a*, which is a continuation of the anterior edge 11*g* and inclined from front to rear and towards the outside of the scraper 11, for rejoining an inner vertical surface 11*i* of the scraper 11. The inclined anterior inner surface 11*f* of the scraper 11 is also joined to the inclined anterior surface 11*c* along an edge 11*j* which, as seen in a plan view as shown in FIG. 2, is inclined from front to rear, toward the outside with respect to the vertical plane of symmetry P.

Due to this particular conformation of the anterior portion of each of the two scrapers 11 which are adjacent to one another and symmetrical with respect to the vertical plane of symmetry P, the interval between the two scrapers 11 will first define, in its anterior portion, a relatively narrow inlet slit, of a width a, formed by the two anterior edges 11*g* parallel to the vertical plane of symmetry P, then an intermediate portion which is rearwardly flaring and is defined by the two edges 11*h*, and finally an interval of a large width b between the two inner vertical faces 11*i*. The space situated underneath the inlet slit, between the two anterior edges 11*g*, and underneath the flaring portion, situated between the two inclined edges 11*h*, has also a flaring shape both rearwardly and downwardly, this space being defined by the two inclined inner anterior surfaces 11*f*.

In order to carry out a clearing operation, i.e. an elimination of the cardboard bits 4 forming the scraps carried by the piercing points 3, each pair of left arm 6 and right arm 7 is locked on the shaft 5 by means of the screws 9, in such a manner that the inlet slit which is defined between the two anterior edges 11*g* will be positioned substantially in register with the piercing points 3 and the piercing points 3 can engage in this inlet slit.

In other words, the arrangement is such that the vertical plane of symmetry P of both arms 6, 7 will coincide practically with the vertical and transverse plane in which can move the piercing points 3. Therefore, when a piercing point 3, carrying therewith a cardboard bit 4, begins to be engaged in the inlet slit between the two edges 11*g*, the cardboard bit 4 carried thereby and which has a lateral dimension which is larger than the width of the inlet slit between the edges 11*g*, begins to slide on the upper surfaces 11*a* of the two scrapers 11.

Due to the inclination of the arms 6 and 7 with respect to the lateral surface of the cutting, cylinder 2, each cardboard bit 4 carried by a piercing point 3 has a tendency to be progressively detached from this piercing point as it slides on the upper surfaces 11*a* of the two scrapers 11. Then, it reaches the flared-out area defined by the two, edges 11*g* where it is then totally detached from the piercing point 3: it can then fall in an underlying recovery device (not shown).

Due to the provision of the space flaring out from front to rear and from top to bottom, in the anterior portion of the scrapers 11, a risk of jamming is totally eliminated since the detached cardboard bits 4 can fall freely in the interval between the two scrapers 11.

What is claimed is:

1. A clearing device associated with a rotary cutting apparatus for cutting a web of material, such as a web of cardboard, said clearing device being comb-shaped and having a common base parallel to an axis of rotation of a cutting cylinder of said rotary cutting apparatus, and supporting a series of pairs of parallel arms or teeth extending towards said cutting cylinder and ending at an anterior portion in an immediate vicinity of a peripheral surface of said cutting cylinder, said pairs of parallel arms including a first and a second arm defining an interval therebetween, a series of piercing points rigidly connected to said peripheral surface of said cutting cylinder for transporting bits of said material in the form of a number of cutting scraps which have been cut from said web of material and are subsequently detached from the piercing points by said parallel arms of said clearing device, and wherein said common base of said comb-shaped clearing device is a shaft which supports locking and adjusting means on each of said parallel arms for positioning each of said parallel arms on said shaft in preselected positions relative to one another and to said series of piercing points on said cutting cylinder such that said piercing points pass through said interval of said parallel arms during rotation of said cutting cylinder, wherein said two arms of each of said pairs are symmetrical with respect to a vertical plane of symmetry (P) passing between said two arms, said two arms having inner faces being directed toward one another and formed in such a manner as to define therebetween said interval having a width which increases moving in a rearward direction from the anterior portion of said parallel arms to said shaft.

2. The device as set forth in claim 1, wherein each one of said parallel arms comprises a base portion formed by a support block, said locking and adjustment means being formed in said support block for clamping and locking each one of said parallel arms on said shaft by means of a screw, and each parallel arm includes a scraper ending in said anterior portion, wherein each scraper extends from said support block and is fixed thereto by means of screws.

3. The device as set forth in claim 2, wherein each said scraper has a flat upper surface which is positioned generally tangent to said peripheral surface of said cutting cylinder and which ends at a forward end thereof in a horizontal edge of said anterior portion, said horizontal edge being parallel to said axis of rotation of said cutting cylinder and being situated in an immediate vicinity of said peripheral surface of said cutting cylinder, said horizontal edge being formed by the intersection of the upper surface and a lower anterior surface, these two surfaces forming an acute angle dihedron so that each said scraper has an anterior portion which is tapered, and each said scraper has an inner face which forms a side of said interval wherein each said inner face includes a flat anterior inner face which is inclined, both downwardly from said upper surface and rearwardly from said horizontal edge, away from said vertical plane of symmetry, said inclined anterior inner face being defined, at its upper portion, by an upper anterior edge which is contained in a plane of said flat upper surface, parallel to said vertical plane of symmetry (P) and connected perpendicularly to said horizontal edge, and by another upper edge also contained in said plane of said flat upper surface, which is a continuation of the upper anterior edge and inclined from front to rear and away from said vertical plane of symmetry and joins an inner surface of said scraper parallel to said vertical plane of symmetry.

4. The device as set forth in claim 3, wherein said inclined anterior inner face is also joined to said lower anterior face along an edge which, is inclined from front to rear, away from to the vertical plane of symmetry (P).

* * * * *